US011565519B2

(12) United States Patent
Kida

(10) Patent No.: US 11,565,519 B2
(45) Date of Patent: Jan. 31, 2023

(54) LIQUID DISCHARGE APPARATUS AND HEAD DRIVE CONTROL DEVICE

(71) Applicant: Hitoshi Kida, Kanagawa (JP)

(72) Inventor: Hitoshi Kida, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 41 days.

(21) Appl. No.: 17/200,813

(22) Filed: Mar. 13, 2021

(65) Prior Publication Data

US 2021/0291517 A1 Sep. 23, 2021

(30) Foreign Application Priority Data

Mar. 18, 2020 (JP) ..... JP2020-047185

(51) Int. Cl.
*B41J 2/045* (2006.01)

(52) U.S. Cl.
CPC ..... *B41J 2/04588* (2013.01); *B41J 2/04581* (2013.01)

(58) Field of Classification Search
CPC ..... B41J 2/04581
See application file for complete search history.

(56) References Cited

U.S. PATENT DOCUMENTS

2003/0142160 A1 7/2003 Kobayashi et al.
2013/0033534 A1* 2/2013 Takano ..... B41J 2/04581 347/10
2016/0067960 A1* 3/2016 Marchant ..... B41J 2/04588 347/10
2016/0067963 A1* 3/2016 van Brocklin ..... B41J 2/04541 347/10
2019/0047281 A1* 2/2019 van Brocklin ..... B41J 2/0455
2019/0202199 A1* 7/2019 Bird ..... B41J 2/04541

FOREIGN PATENT DOCUMENTS

JP 11-058781 3/1999
JP 2003-211664 7/2003
JP 2011-110821 6/2011
JP 2011-110935 6/2011
JP 2011110935 A * 6/2011 ..... B41J 2/04541

OTHER PUBLICATIONS

U.S. Appl. No. 16/952,447, filed Nov. 19, 2020, Hitoshi Kida.

* cited by examiner

*Primary Examiner* — Shelby L Fidler
(74) *Attorney, Agent, or Firm* — Duft & Bornsen, PC

(57) ABSTRACT

A liquid discharge apparatus includes a head and a switching device. The head includes a piezoelectric element and a pressure chamber configured to discharge liquid. The switching device is configured to select application or non-application of a drive voltage waveform to the piezoelectric element. The drive voltage waveform includes a discharge waveform to pressurize and discharge the liquid in the pressure chamber and a damping waveform to suppress residual vibration in the pressure chamber. The damping waveform is disposed after the discharge waveform in time series. The switching device includes a switch and a diode. The switch is configured to be turned on in a falling waveform element of each of the discharge waveform and the damping waveform. The diode is connected in parallel with the switch in a direction opposite to the falling waveform element of each of the discharge waveform and the damping waveform.

9 Claims, 13 Drawing Sheets

LIQUID DISCHARGE APPARATUS AND HEAD DRIVE CONTROL DEVICE

CROSS-REFERENCE TO RELATED APPLICATION

This patent application is based on and claims priority pursuant to 35 U.S.C. § 119(a) to Japanese Patent Application No. 2020-047185, filed on Mar. 18, 2020, in the Japan Patent Office, the entire disclosure of which is hereby incorporated by reference herein.

BACKGROUND

Technical Field

Embodiments of the present disclosure relate to a liquid discharge apparatus and a head drive control device.

Related Art

In a liquid discharge head, the discharge speed and the discharge amount of liquid vary among nozzles due to, for example, variations in manufacturing.

There are known technologies that uniform the discharge amount of droplets (or the weight of discharged droplets) among a plurality of nozzles. For example, the time for fixing, to the ground potential (GND), one terminal for applying a falling portion of a lamp-shaped drive waveform (in other words, an electric discharge period of the drive waveform) to the piezoelectric element is adjusted by a switch to adjust the displacement amount of the piezoelectric element. Then, the piezoelectric element is fixed to GND by a diode at a rising portion of the drive waveform to return to the original displacement amount.

SUMMARY

According to an aspect of the present disclosure, there is provided a liquid discharge apparatus that includes a head and a switching device. The head includes a piezoelectric element and a pressure chamber configured to discharge liquid. The switching device is configured to select application or non-application of a drive voltage waveform to the piezoelectric element. The drive voltage waveform includes a discharge waveform to pressurize and discharge the liquid in the pressure chamber and a damping waveform to suppress residual vibration in the pressure chamber. The damping waveform is disposed after the discharge waveform in time series. The switching device includes a switch and a diode. The switch is configured to be turned on in a falling waveform element of each of the discharge waveform and the damping waveform. The diode is connected in parallel with the switch in a direction opposite to the falling waveform element of each of the discharge waveform and the damping waveform.

According to another aspect of the present disclosure, there is provided a liquid discharge apparatus that includes a head and a switching device. The head includes a piezoelectric element and a pressure chamber configured to discharge liquid. The switching device is configured to select application or non-application of a drive voltage waveform to the piezoelectric element. The drive voltage waveform includes a discharge waveform to pressurize and discharge the liquid in the pressure chamber and a damping waveform to suppress residual vibration in the pressure chamber. The damping waveform is disposed after the discharge waveform in time series. The switching device includes a switch and a diode. The switch is configured to be turned on in a rising waveform element of each of the discharge waveform and the damping waveform. The diode is connected in parallel with the switch in a direction opposite to the rising waveform element of each of the discharge waveform and the damping waveform.

According to still another aspect of the present disclosure, there is provided a head drive control device that includes a switching device configured to select application or non-application of a drive voltage waveform to a piezoelectric element of a head configured to discharge liquid. The drive voltage waveform includes a discharge waveform to pressurize and discharge the liquid in the pressure chamber and a damping waveform to suppress residual vibration in the pressure chamber. The damping waveform is disposed after the discharge waveform in time series. The switching device includes a switch and a diode. The switch is configured to be turned on in a falling waveform element of each of the discharge waveform and the damping waveform. The diode is connected in parallel with the switch in a direction opposite to the falling waveform element of each of the discharge waveform and the damping waveform.

According to still yet another aspect of the present disclosure, there is provided a head drive control device that includes a switching device configured to select application or non-application of a drive voltage waveform to a piezoelectric element of a head configured to discharge liquid. The drive voltage waveform includes a discharge waveform to pressurize and discharge the liquid in the pressure chamber and a damping waveform to suppress residual vibration in the pressure chamber. The damping waveform is disposed after the discharge waveform in time series. The switching device includes a switch and a diode. The switch is configured to be turned on in a rising waveform element of each of the discharge waveform and the damping waveform. The diode is connected in parallel with the switch in a direction opposite to the rising waveform element of each of the discharge waveform and the damping waveform.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
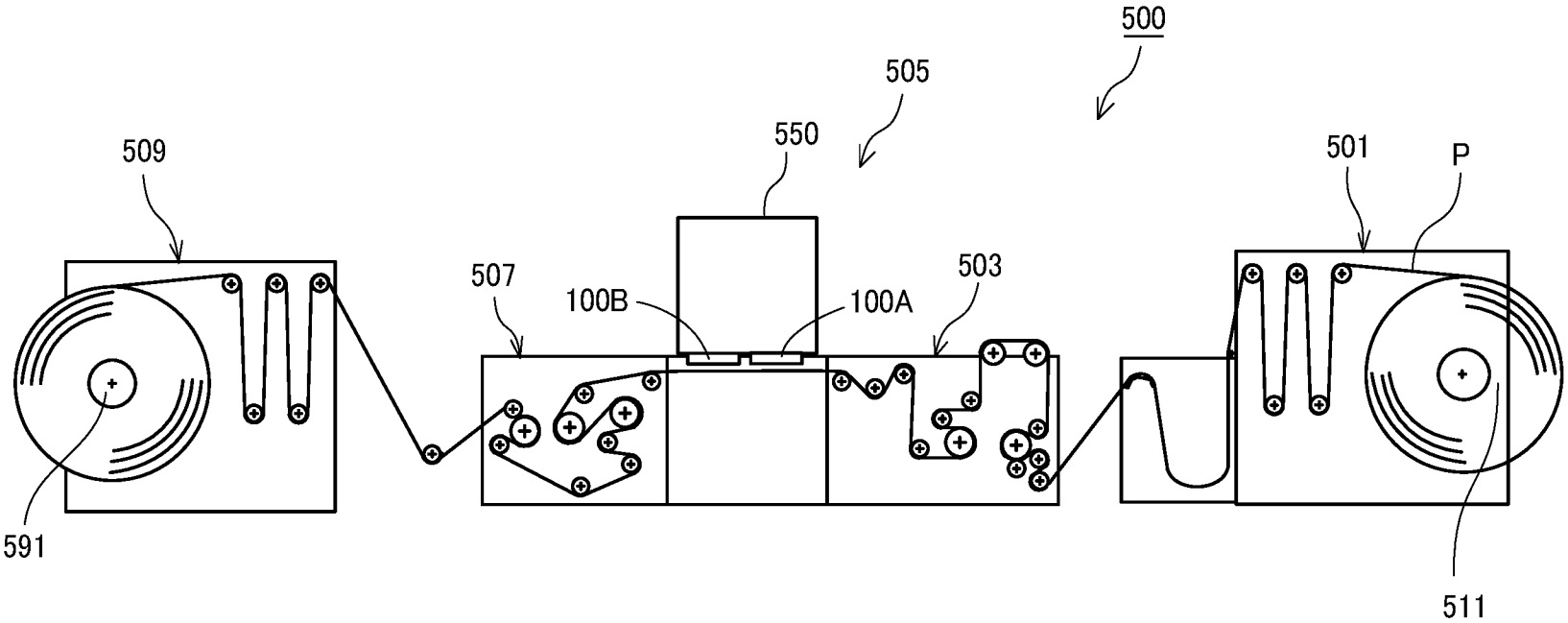
FIG. 1 is a schematic view of a printer as a liquid discharge apparatus according to a first embodiment of the present disclosure.

The accompanying drawings are intended to depict embodiments of the present disclosure and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present disclosure. As used herein, the singular forms "a", "an" and "the" are intended to include the plural forms as well, unless the context clearly indicates otherwise.

In describing embodiments illustrated in the drawings, specific terminology is employed for the sake of clarity. However, the disclosure of this specification is not intended to be limited to the specific terminology so selected and it is to be understood that each specific element includes all technical equivalents that have a similar function, operate in a similar manner, and achieve a similar result.

With reference to drawings, descriptions are given below of embodiments of the present disclosure. It is to be noted that elements (for example, mechanical parts and components) having the same functions and shapes are denoted by the same reference numerals throughout the specification and redundant descriptions are omitted.

Hereinafter, embodiments of the present disclosure are described with reference to the drawings.

Figure 2:
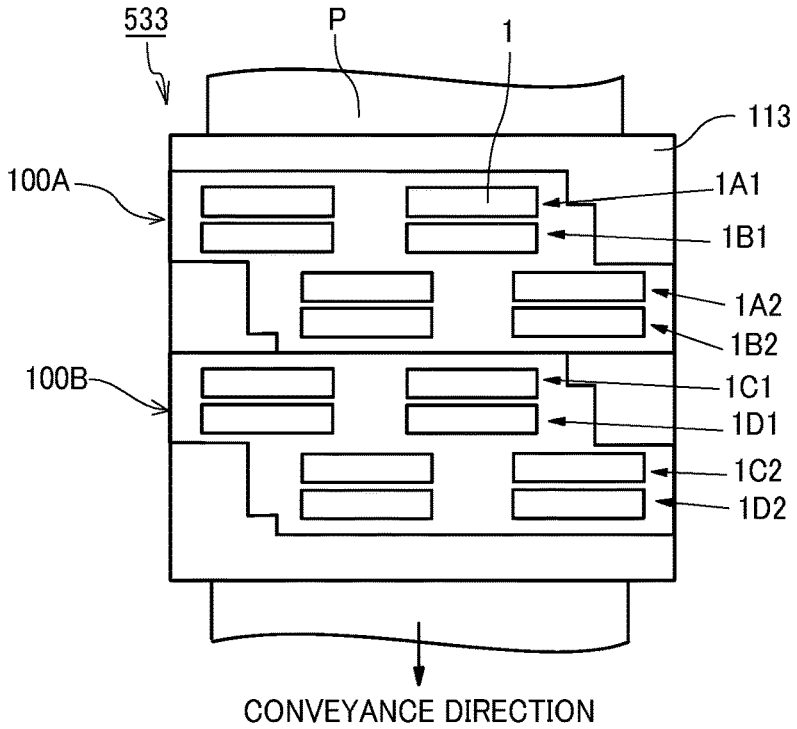
FIG. 2 is an illustration of a discharge unit of the printer of FIG. 1.

Referring now to the drawings, wherein like reference numerals designate identical or corresponding parts throughout the several views, exemplary embodiments of the present disclosure are described below. A printer as a liquid discharge apparatus according to a first embodiment of the present disclosure is described with reference to FIGS. 1 and 2. FIG. 1 is a schematic view of the printer according to the eighth embodiment. FIG. 2 is an illustration of a discharge unit of the printer.

A liquid discharge apparatus 500 according to an embodiment of the present disclosure is a printer, and includes a carry-in unit 501, a guide conveyance unit 503, a printing unit 505, a drying unit 507, a carry-out unit 509, and the like.

The carry-in unit 501 carries in a web-shaped sheet material P. The guide conveyance unit 503 guides and conveys the sheet material P carried in from the carry-in unit 501 to the printing unit 505. The printing unit 505 performs printing to discharge liquid onto the sheet material P to form an image. The drying unit 507 dries the sheet material P. The carry-out unit 509 carries out the sheet material P.

The sheet material P is sent out from an original winding roller 511 of the carry-in unit 501, guided and conveyed by rollers of the carry-in unit 501, the guide conveyance unit 503, the drying unit 507, and the carry-out unit 509, and wound by a winding roller 591 of the carry-out unit 509.

In the printing unit 505, the sheet material P is conveyed on a conveyance guide member so as to face a head unit 550, and an image is printed on the sheet material P with liquid discharged from the head unit 550.

The head unit 550 includes two head modules 100A and 100B on a common base member 552. Hereinafter, the head modules 100A and 100B may be referred to as head modules 100 unless distinguished.

When a direction in which heads 1 are aligned in the head module 100 in a direction orthogonal to a conveyance direction of the sheet material P and is defined as a head alignment direction, head rows 1A1 and 1A2 of the head module 100A discharge liquid of the same color. Similarly, a pair of head rows 1B1 and 1B2 of the head module 100A, a pair of head rows 1C1 and 1C2 of the head module 100B, and a pair of head rows 1D1 and 1D2 discharge liquids of required colors, respectively.

Figure 3:
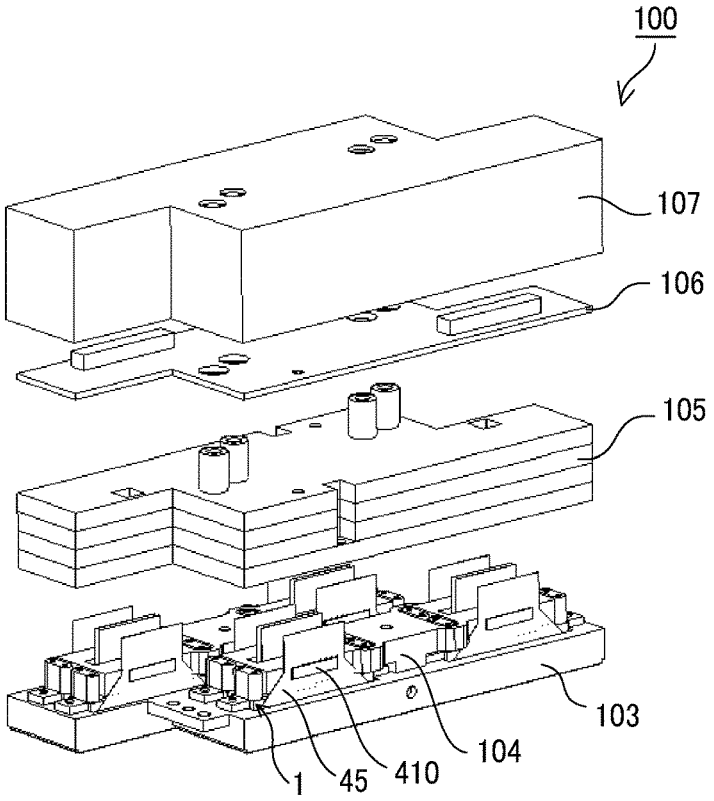
FIG. 3 is an exploded perspective view of a head module in the first embodiment.
Figure 4:
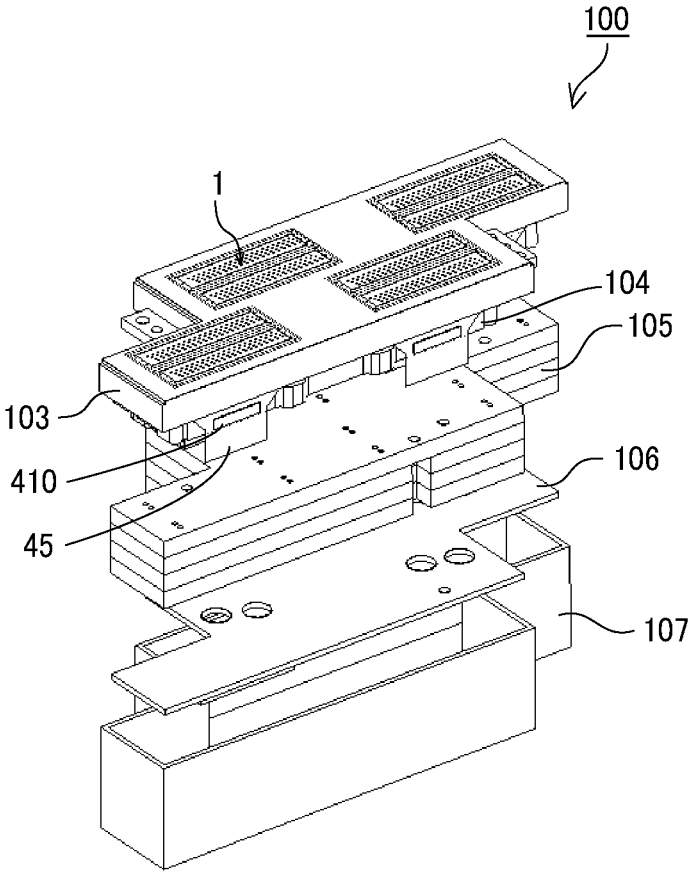
FIG. 4 is an exploded perspective view of the head module of FIG. 3 as viewed from a nozzle surface side.

Next, an example of the head module according to the present embodiment is described with reference to FIGS. 3 and 4. FIG. 3 is an exploded perspective view of the head module. FIG. 4 is an exploded perspective view of the head module as viewed from a nozzle surface side.

The head module 100 includes a plurality of heads 1, which are liquid discharge heads to discharge liquid, and a base member 103 that holds the plurality of heads 1.

In addition, the head module 100 includes a heat dissipation member 104, a manifold 105 forming channels to supply liquid to the plurality of heads 1, a printed circuit board (PCB) 106 connected to wiring boards (or flexible wiring members) 101, and a module case 107.

Figure 5:
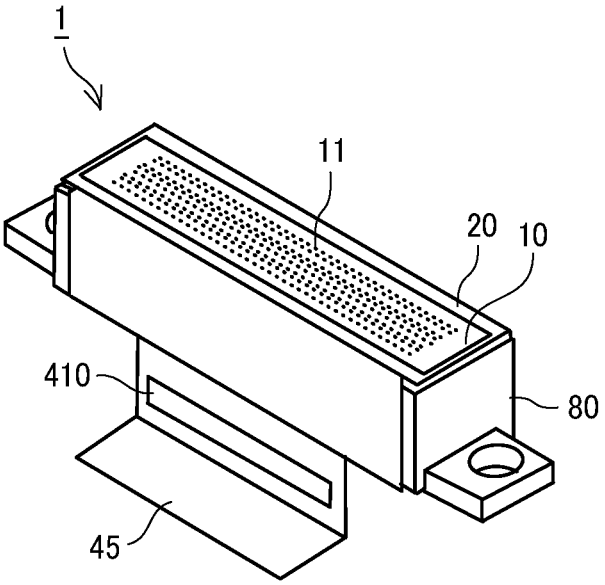
FIG. 5 is an external perspective view of an example of a head in the first embodiment as viewed from a nozzle surface side.
Figure 6:
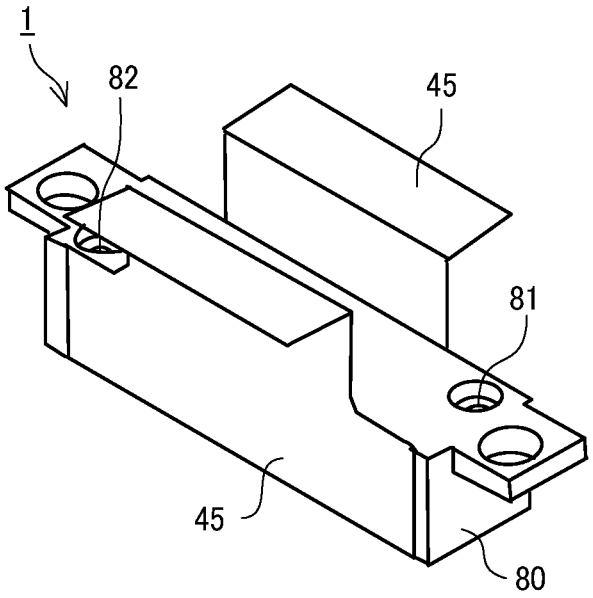
FIG. 6 is an exploded perspective view of the head of FIG. 5 as viewed from the opposite side of the nozzle surface side.
Figure 7:
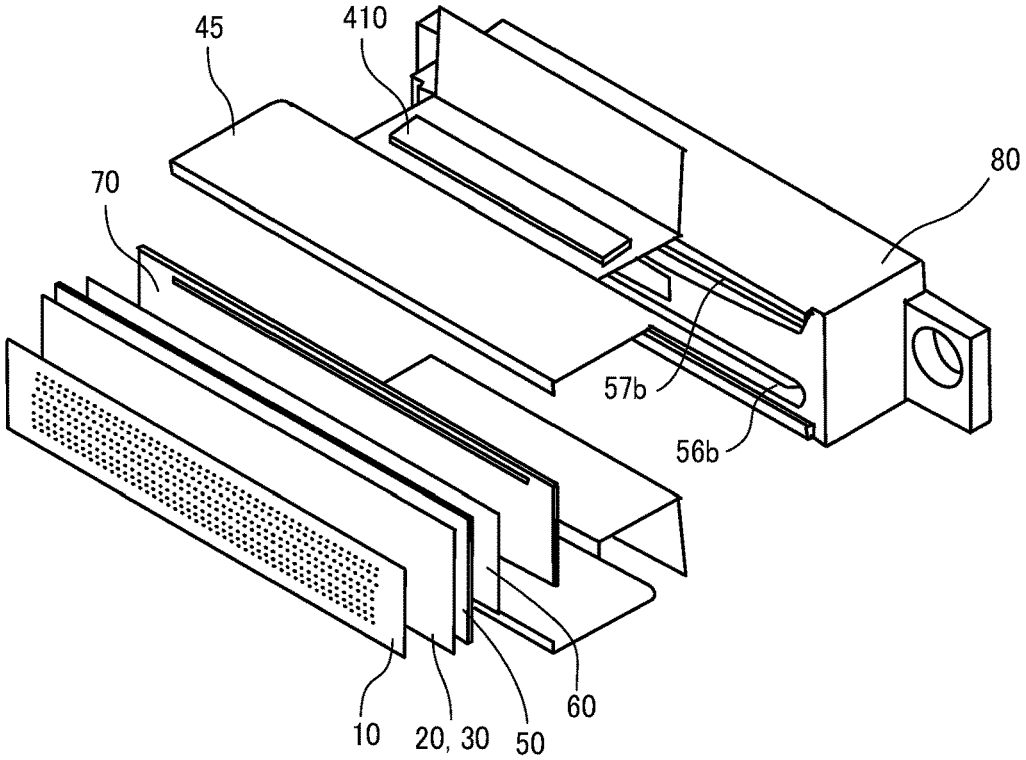
FIG. 7 is an exploded perspective view of the head of FIG. 5.
Figure 8:
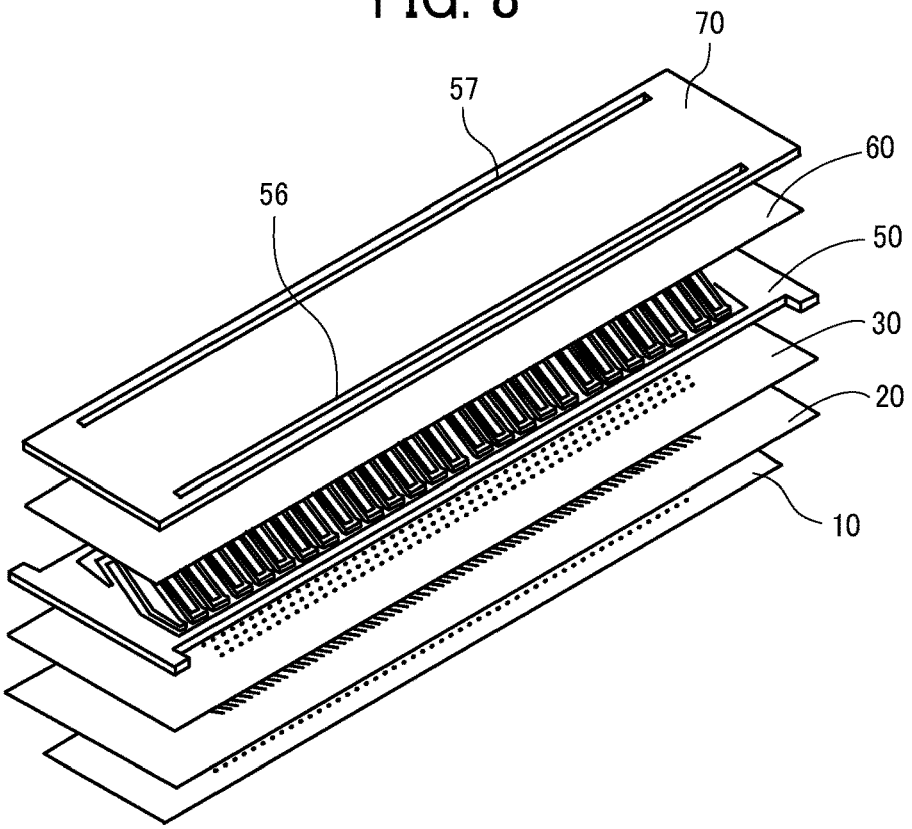
FIG. 8 is an exploded perspective view of channel forming members of the head of FIG. 5.
Figure 9:
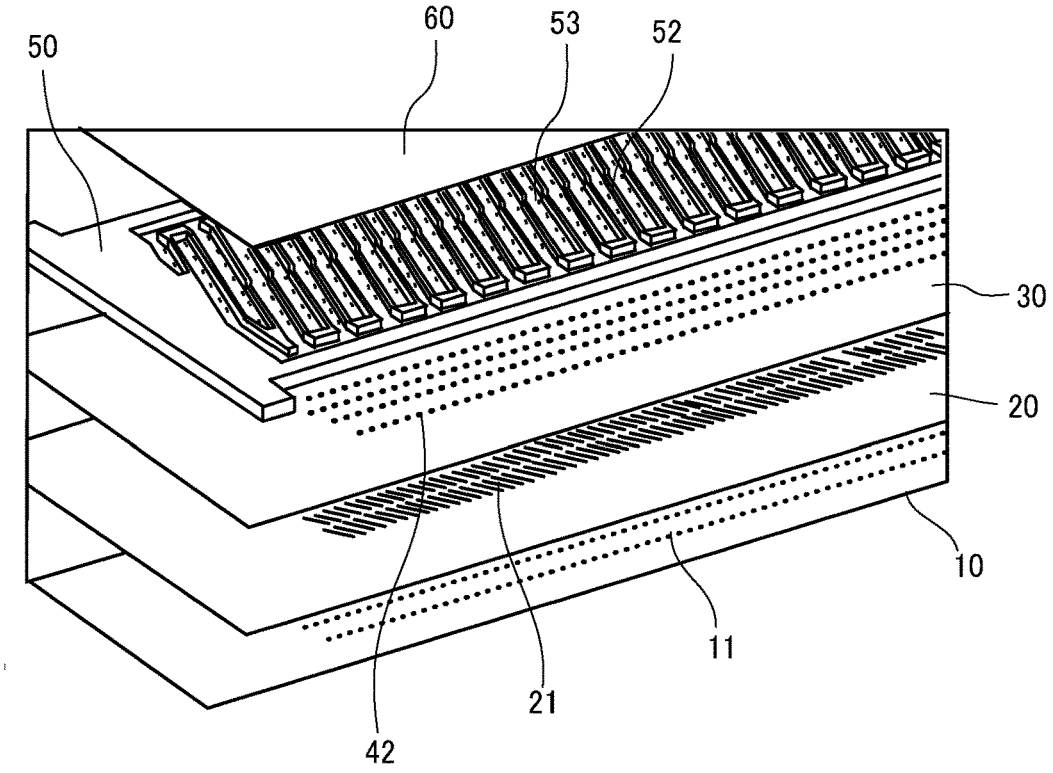
FIG. 9 is an enlarged perspective view of a part of the channel forming members of FIG. 8.
Figure 10:
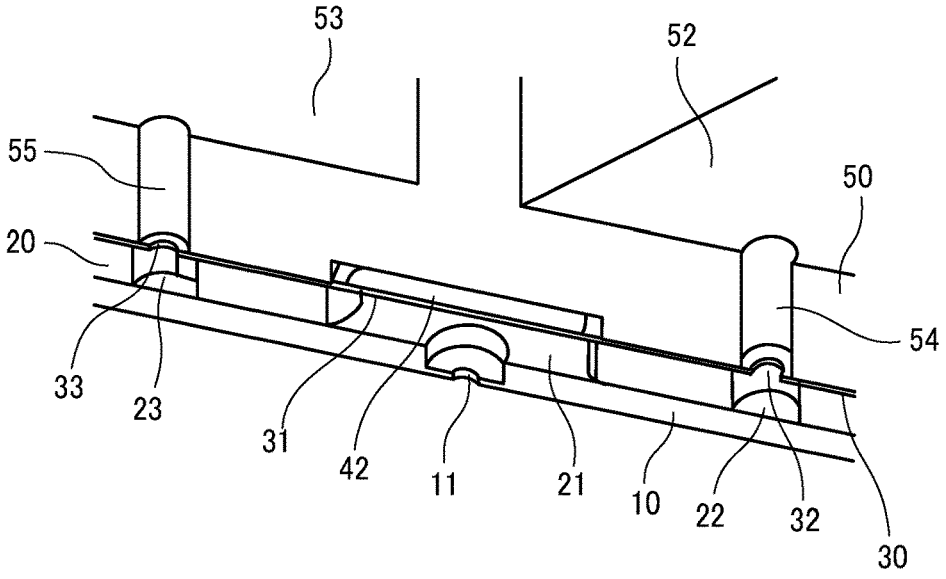
FIG. 10 is a cross-sectional perspective view of a channel portion of the channel forming members of FIG. 8.

Next, an example of the head in the first embodiment is described with reference to FIGS. 5 to 10. FIG. 5 is an external perspective view of the head as viewed from the nozzle surface side. FIG. 6 is an external perspective view of the head as viewed from the side opposite to the nozzle surface. FIG. 7 is an exploded perspective view of the head. FIG. 8 is an exploded perspective view of channel forming members. FIG. 9 is an enlarged perspective view of a main part of the channel forming members illustrated in FIG. 8. FIG. is a sectional perspective view of a channel portion of the channel forming members illustrated in FIG. 8.

The head 1 includes, e.g., a nozzle plate 10, a channel plate (individual channel substrate) 20, a diaphragm substrate 30, a common channel substrate 50, a damper substrate 60, a common channel substrate 70, a frame substrate 80, and a wiring member (flexible wiring board) 45. A head driver (driver integrated circuit (IC)) 410 is mounted on the wiring member 45.

The nozzle plate 10 includes a plurality of nozzles 11 to discharge liquid. The plurality of nozzles 11 are arranged in a two-dimensional matrix.

The individual channel substrate 20 forms a plurality of pressure chambers (individual liquid chambers) 21 that communicate with the plurality of nozzles 11, a plurality of individual supply channels 22 that communicate with the plurality of pressure chambers 21, and a plurality of individual collection channels 23 that communicate with the plurality of pressure chambers 21. One pressure chamber 21 and one of the individual supply channels 22 and one of the individual collection channels 23 that communicate with this pressure chamber 21 are collectively referred to as an individual channel 25.

The diaphragm substrate 30 forms a diaphragm 31 that is a deformable wall of the pressure chamber 21. The diaphragm 31 is integrated with a piezoelectric element 42. Further, the diaphragm substrate 30 includes a supply-side opening 32 that communicates with the individual supply channel 22 and a collection-side opening 33 that communicates with the individual collection channel 23. The piezoelectric element 42 is a pressure generator that deforms the diaphragm 31 to pressurize liquid in the pressure chamber 21.

The individual channel substrate 20 and the diaphragm substrate 30 are not limited to be separate members. For example, the individual channel substrate 20 and the diaphragm substrate 30 may be integrated as a single member using a silicon on insulator (SOI) substrate. That is, an SOI substrate in which a silicon oxide film, a silicon layer, and a silicon oxide film are formed in this order on a silicon substrate can be used. The silicon substrate serves as the individual channel substrate 20, and the silicon oxide film, the silicon layer, and the silicon oxide film constitute the diaphragm 31. In such a configuration, the layer structure of the silicon oxide film, the silicon layer, and the silicon oxide film of the SOI substrate constitutes the diaphragm substrate 30. Thus, the diaphragm substrate 30 may be composed of materials formed as films on the surface of the individual channel substrate 20.

The common channel substrate 50 is a common channel branch member, and includes a plurality of common supply channel tributaries 52 that communicate with two or more individual supply channels 22 and a plurality of common collection channel tributaries 53 that communicate with two or more individual collection channels 23. The plurality of common supply channel tributaries 52 and the plurality of common collection channel tributaries 53 are alternately arranged adjacent to each other.

The common channel substrate 50 forms a through hole serving as a supply port 54 that communicates the supply-side opening 32 of the individual supply channel 22 with the common supply channel tributary 52, and another through hole serving as a collection port 55 that communicates the collection-side opening 33 of the individual collection channel 23 with the common collection channel tributary 53.

Further, the common channel substrate 50 forms a part 56*a* of the one or more common supply channel mainstreams 56 communicating with the plurality of common supply channel tributaries 52 and a part 57*a* of one or more common collection channel mainstreams 57 communicating with the plurality of common collection channel tributaries 53.

The damper substrate 60 includes a supply-side damper 62 that faces (or opposes) the supply port 54 of the common supply channel tributary 52, and a collection-side damper 63 that faces (or opposes) the collection port 55 of the common collection channel tributary 53.

Here, the common supply channel tributary 52 and the common collection channel tributary 53 are configured by sealing groove portions alternately arranged in the common channel substrate 50, which is the same member, with the damper substrate 60 forming a deformable wall surface.

The common channel substrate 70 is a common channel mainstream member and forms a common supply channel mainstream 56 communicating with the plurality of common supply channel tributaries 52 and a common collection channel mainstream 57 communicating with the plurality of common collection channel tributaries 53.

A part 56*b* of the common supply channel mainstream 56 and a part 57*b* of the common collection channel mainstream 57 are formed in the frame substrate 80. The part 56*b* of the common supply channel mainstream 56 communicates with the supply port 81 provided in the frame substrate 80. The part 57*b* of the common collection channel mainstream 57 communicates with the collection port 82 provided in the frame substrate 80.

In the head 1, liquid passes from the common supply channel mainstream 56 through the common supply channel tributary 52, is supplied from the supply port 54 to the pressure chamber 21, and is discharged from the nozzle 11. The liquid not discharged from the nozzle 11 passes through the collection port 55, the common collection channel tributary 53, and the common collection channel mainstream 57, and is supplied again to the common supply channel mainstream 56 through the collection port 82, an external circulation device, and the supply port 81.

Figure 11:
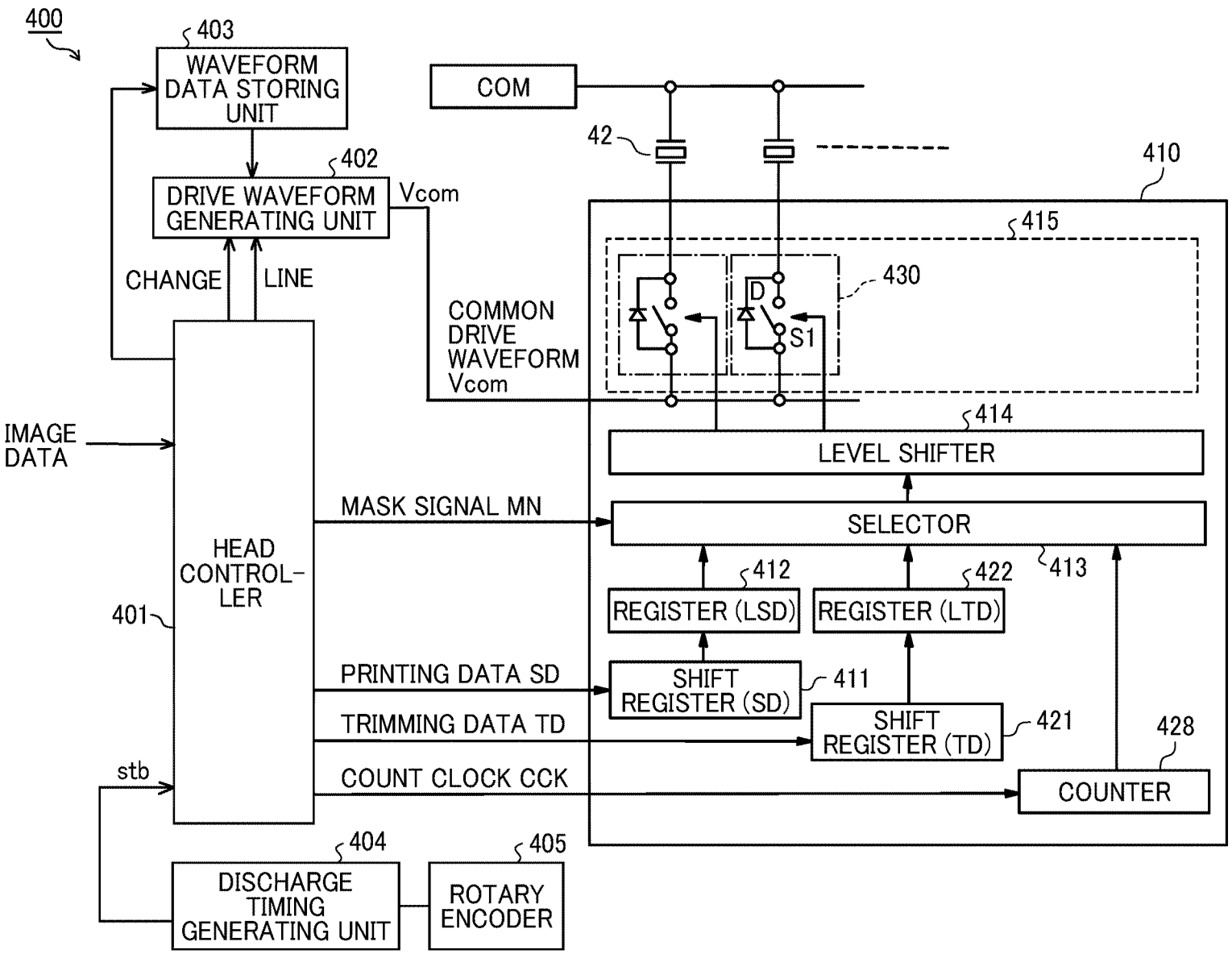
FIG. 11 is a block diagram of a head drive control device in the first embodiment.

Next, a head drive control device according to the first embodiment of the present disclosure is described with reference to FIG. 11. FIG. 11 is a block diagram of the head drive control device according to the first embodiment.

The head drive control device 400 according to the first embodiment includes a head controller 401, a drive waveform generating unit 402 and a waveform data storage unit 403 that constitute a drive waveform generator, a discharge timing generating unit 404 to generate a discharge timing from an output of a rotary encoder 405, and a head driver 410.

In response to a reception of a discharge timing pulse stb, the head controller 401 outputs a discharge synchronization signal LINE that triggers generation of a common drive waveform Vcom, to the drive waveform generating unit 402. The head controller 401 outputs a discharge timing signal CHANGE corresponding to the amount of delay from the discharge synchronization signal LINE, to the drive waveform generating unit 402.

The drive waveform generating unit 402 generates and outputs a common drive waveform Vcom at the timing based on the discharge synchronization signal LINE and the discharge timing signal CHANGE.

The head controller 401 receives the image data and generates, based on the image data, a mask signal MN to control the presence or absence of liquid discharge from each nozzle 11 of the head 100. The mask signal MN is a signal at a timing synchronized with the discharge timing signal CHANGE.

The head controller 401 transfers printing data SD, trimming data TD, a counter clock signal CCK, and the generated mask signal MN to the head driver 410.

The head driver 410 is a selection unit that selects a waveform portion to be applied to each piezoelectric element 42 of the head 100 from the common drive waveform Vcom, based on various signals from the head controller 401.

The head driver 410 includes a shift register 411, a register 412, a selector 413, a level shifter 414, and a switch array 415.

The head driver 410 further includes a shift register 421, a register 422, and a counter 428.

The shift register 411 receives the printing data SD transferred from the head controller 401. The register 412 stores each register value of the shift register 411.

Similarly, the shift register 421 receives the trimming data TD from the head controller 401. The register 422 stores each register value of the shift register 421.

The selector 413 is a selection unit to output a result from the value (printing data SD) stored in the register 412 and the mask signal MN.

The selector 413 receives a value (trimming data TD) stored in the register 422 and an output signal (count value) from the counter 428.

The selector 413 outputs a signal for turning off a first switch S1 when the count result of the counter 428 reaches a value T of the trimming data TD, according to the trimming data TD that are held in the register 422 for a discharge waveform Pa and a damping waveform Pb included in the common drive waveform Vcom for the nozzle 11 discharging liquid.

The level shifter 414 converts the level of a logic level voltage signal of the selector 413 to a level at which the first switch S1 of the switch array 415 can operate.

The switch array 415 includes a switching unit 430 as a switching device that selects passing or non-passing (blocking) of the common drive waveform Vcom, in other words, application or non-application of the drive voltage waveform to the piezoelectric element 42. Each piezoelectric element 42 has a first side and a second side opposite the first side. The first side is connected to the switching unit 430 and the second side is connected to GND or COM which is at a substantially constant voltage.

In the present embodiment, the first switch S1 of the switching unit 430 is an analog switch as a switching element that is turned on and off by the output of the selector 413 supplied through the level shifter 414. In the present embodiment, the first switch S1 also switches passing or non-passing (blocking) of the common drive waveform Vcom.

The first switch S1 is provided for each nozzle 11 of the head 1 and is connected to an individual electrode of the piezoelectric element 42 corresponding to each nozzle 11. The common drive waveform Vcom from the drive waveform generating unit 402 is input to the first switch S1.

Accordingly, the first switch S1 is switched on and off at an appropriate timing in accordance with the output of the selector 413 supplied via the level shifter 414. Thus, the waveform portion applied to the piezoelectric element 42 corresponding to each nozzle 11 is selected from the common drive waveform Vcom. As a result, the sizes of droplets discharged from the nozzle 11 are controlled, and droplets of different sizes are discharged.

The discharge timing generating unit 404 generates and outputs the discharge timing pulse stb each time the sheet material P is moved by a predetermined amount, based on the detection result of the rotary encoder 405. The rotary encoder 405 includes an encoder wheel that rotates in accordance with the movement of the sheet material P and an encoder sensor that reads a slit of the encoder wheel.

Figure 12:
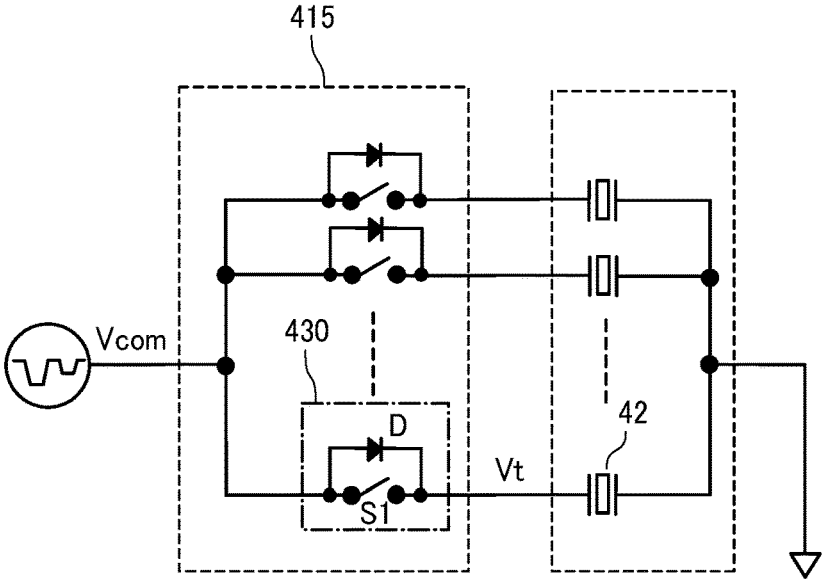
FIG. 12 is an explanatory view of a switch portion of a head driver of the head drive control device of FIG. 11.
Figure 13:
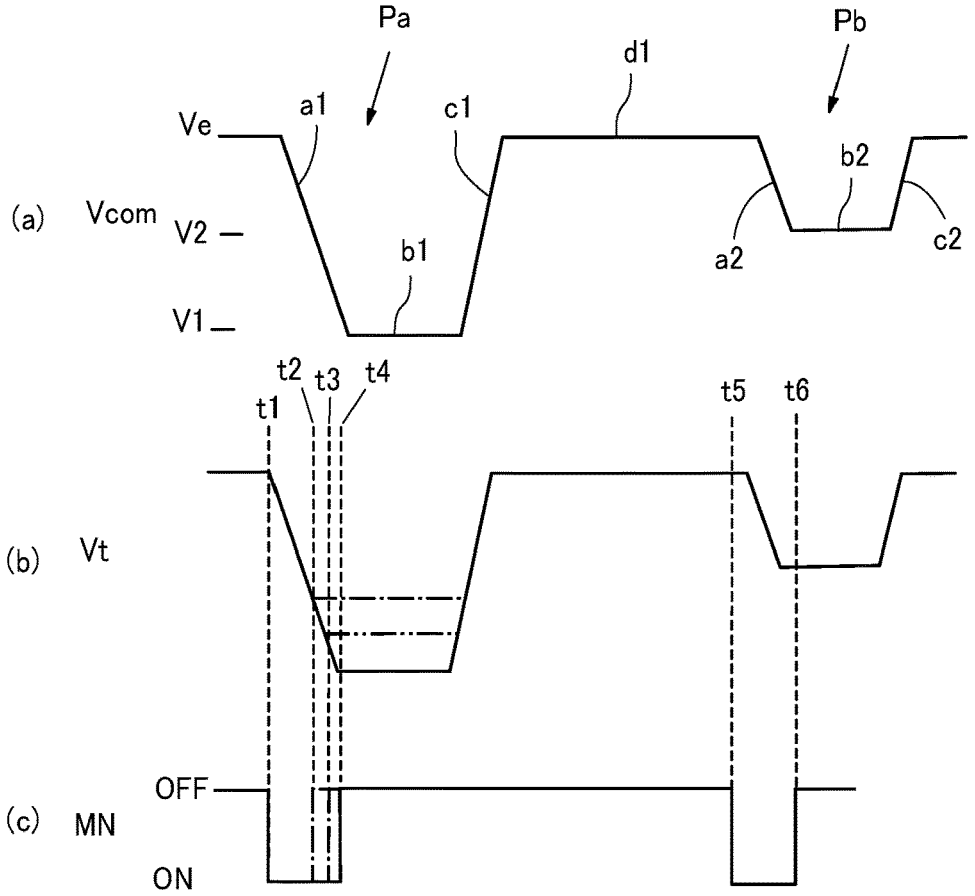
FIG. 13 is a diagram illustrating an operation of the switch portion of FIG. 12.

Next, a switch portion for adjusting the drive voltage waveform of the head driver is described with reference to FIGS. 12 and 13. FIG. 12 is an illustration of a switch portion of the head driver. FIG. 13 is a diagram illustrating an operation of the switch portion.

In the present embodiment, after the step of pulling the meniscus of the nozzle 11 is performed, the step of pushing out the meniscus is performed to discharge liquid. For example, there is a case in which the d33 mode of the piezoelectric element is used to pull in the meniscus at the falling edge (electric discharge) of the drive voltage waveform and push out the meniscus at the rising edge (electric charging) of the drive voltage waveform (pulling discharge in the d33 mode). Alternatively, even when the d31 mode of the piezoelectric element is used to pull in the meniscus at the rising edge (electric charging) of the drive voltage waveform and push out the meniscus at the falling edge (electric discharging) of the drive voltage waveform, droplets are performed by performing the step of pushing out the meniscus before performing the step of pulling in the meniscus (pushing discharge in the d31 mode).

Therefore, in the present embodiment, for example, the common drive waveform Vcom that is the drive voltage waveform illustrated in part (a) of FIG. 13 is input.

The common drive waveform Vcom includes a discharge waveform Pa for pressurizing and discharging liquid in the pressure chamber 21 and a damping waveform Pb for suppressing residual vibration of the pressure chamber 21 after the liquid is discharged.

The discharge waveform Pa includes a falling waveform element a1, a holding waveform element b1, and a rising waveform element c1. The falling waveform element a1 falls from a reference potential Ve to a potential V1 to expand the pressure chamber 21. The holding waveform element b1 holds the potential V1 that has fallen in the falling waveform element a1. The rising waveform element c1 rises from the potential V1 held by the holding waveform element b1 to the reference potential Ve to contract the pressure chamber 21 and discharge the liquid.

The damping waveform Pb includes a holding waveform element dl that holds the reference potential Ve that has risen at the rising waveform element c1 of the discharge waveform element Pa, a falling waveform element a2, a holding waveform element b2, and a rising waveform element c2. The falling waveform element a2 falls from the reference potential Ve held by the holding waveform element dl to a potential V2 (V2>V1) to expand the pressure chamber 21. The holding waveform element b2 holds the potential V2 that has fallen in the falling waveform element a1. The rising waveform element c2 rises from the potential V2 held by the holding waveform element b2 to the reference potential Ve to contract the pressure chamber 21. In the damping waveform Pb, liquid is not discharged.

In the present embodiment, the switching unit 430 includes a parallel circuit of the first switch S1 and a diode D. The common drive waveform Vcom is input to and trimmed in the parallel circuit of the first switch S1 and the diode D, and the trimmed drive waveform Vt is applied to the individual electrode side of the piezoelectric element 42.

The first switch S1 selects application or non-application of the drive voltage waveform to the piezoelectric element 42 and trims the discharge waveform Pa.

The anode side of the diode D connected in parallel with the first switch S1 is connected to the input side of the common drive waveform Vcom of the first switch S1. The cathode side of the diode D is connected to the individual electrode side of the piezoelectric element 42. Accordingly, the diode D is connected in a direction opposite to each falling waveform element of the discharge waveform and the damping waveform.

In the first embodiment configured as described above, the mask signal MN is set to the OFF state and the ON state as illustrated in part (c) of FIG. 13.

In other words, the mask signal MN transitions to the ON state from a time point t1 before the falling start of the falling waveform element a1 of the discharge waveform Pa. Thereafter, the mask signal MN transitions to the OFF state at a time point t2, a time point t3, or a time point t4 at which the counter 428 turns off the first switch S1.

Further, the mask signal MN transitions to the ON state at a time point t5 of the holding waveform element dl before the falling start of the falling waveform element a2 of the damping waveform Pb, and transitions to the OFF state at a time point t6 of the holding waveform element b2 after the falling end of the falling waveform element a2.

The falling waveform element a1 of the discharge waveform Pa and the falling waveform element a2 of the damping waveform Pb pass through the first switch S1 when the mask signal MN is in the ON state. That is, the head controller 401 is a unit that turns on the first switch S1 at the falling waveform element a1 of the discharge waveform Pa and the falling waveform element a2 of the damping waveform Pb.

The rising waveform elements c1 and c2 of the discharge waveform Pa and the damping waveform Pb are in the forward direction with respect to the diode D. Accordingly, even when the first switch S1 is turned off, the rising waveform elements c1 and c2 are applied to the piezoelectric element 42 via the diode D.

Thus, the drive waveform Vt illustrated in part (b) of FIG. 13 is applied to the piezoelectric element 42.

Here, when the mask signal MN transitions from the ON state to the OFF state at the time point t4, the falling potential of the drive waveform Vt applied to the piezoelectric element 42 is equal to the falling end potential of the falling waveform element a1 of the discharge waveform Pa. Accordingly, the piezoelectric element 42 electrically discharges largely, and the speed and weight of the droplet discharged from the nozzle are relatively large.

When the mask signal MN transitions from the ON state to the OFF state at the time point t3, the falling potential of the drive waveform Vt applied to the piezoelectric element 42 is higher than the falling end potential of the falling waveform element a1 of the discharge waveform Pa. Accordingly, the piezoelectric element 42 electrically discharges to a medium level, and the speed and weight of the droplet discharged from the nozzle are relatively medium.

When the mask signal MN transitions from the ON state to the OFF state at the time point t2, the falling potential of the drive waveform Vt applied to the piezoelectric element 42 is higher than the falling potential of the drive waveform Vt applied when the mask signal MN transitions at the time point t3. Accordingly, the piezoelectric element 42 is electrically discharged slightly, and the speed and weight of the droplet discharged from the nozzle are relatively small.

In this manner, adjustment can be performed by changing the ON time (or the switch OFF timing) of the mask signal MN that passes through the falling waveform element a1 of the discharge waveform Pa.

At this time, the discharge characteristics of droplets are adjusted by adjusting the OFF timing (time points t2 to t4) of the first switch S1 that has been turned to be the ON time in advance with respect to the falling waveform element a1 of the discharge waveform Pa.

The rising waveform element c1 of the discharge waveform Pa can electrically charge the piezoelectric element 42 through the diode D without turning on the first switch S1.

On the other hand, for the falling waveform element a2 of the damping waveform Pb, the first switch S1 is turned on again, and thus the piezoelectric element 42 can be electrically discharged.

The rising waveform element c2 of the damping waveform Pb does not need to turn on the first switch S1, and can electrically charge the piezoelectric element 42 through the diode D.

Thus, the waveform obtained by adjusting the voltage of the discharge waveform Pa and the subsequent damping waveform Pb can be applied to the piezoelectric element 42. Since it is not necessary to turn on the first switch S1 and the piezoelectric element 42 is electrically charged through the diode D, there is also an advantage that it is not necessary to turn on the first switch S1 at the timing when the rising waveform element c1 of the discharge waveform Pa is equal to the potential of the piezoelectric element 42.

In addition, even in the case of a configuration in which a drive waveform is applied to the individual terminal side (switch side) instead of GND, according to the present embodiment, trimming can be performed while applying a damping waveform from the individual terminal to the piezoelectric element via the switch.

Figure 14:
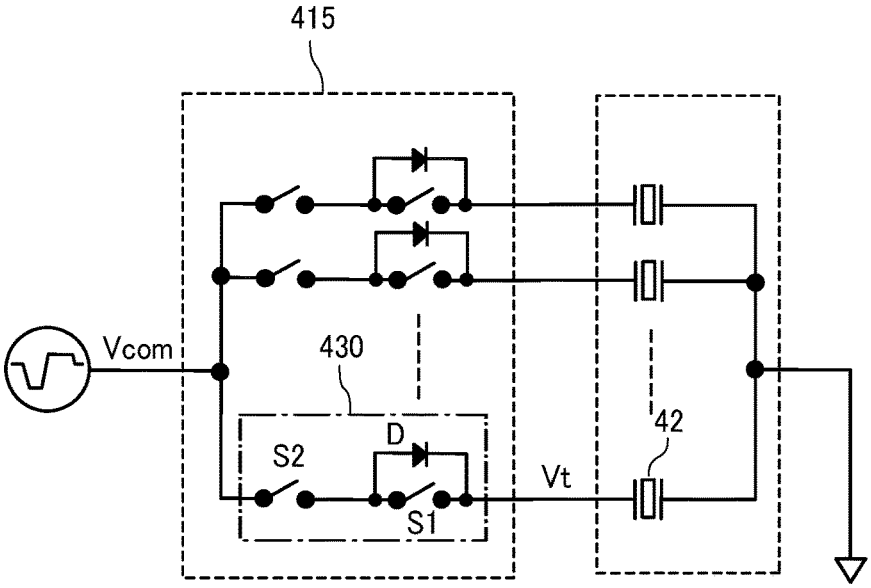
FIG. 14 is an illustration of a switch portion of a head driver according to a second embodiment of the present disclosure.
Figure 15:
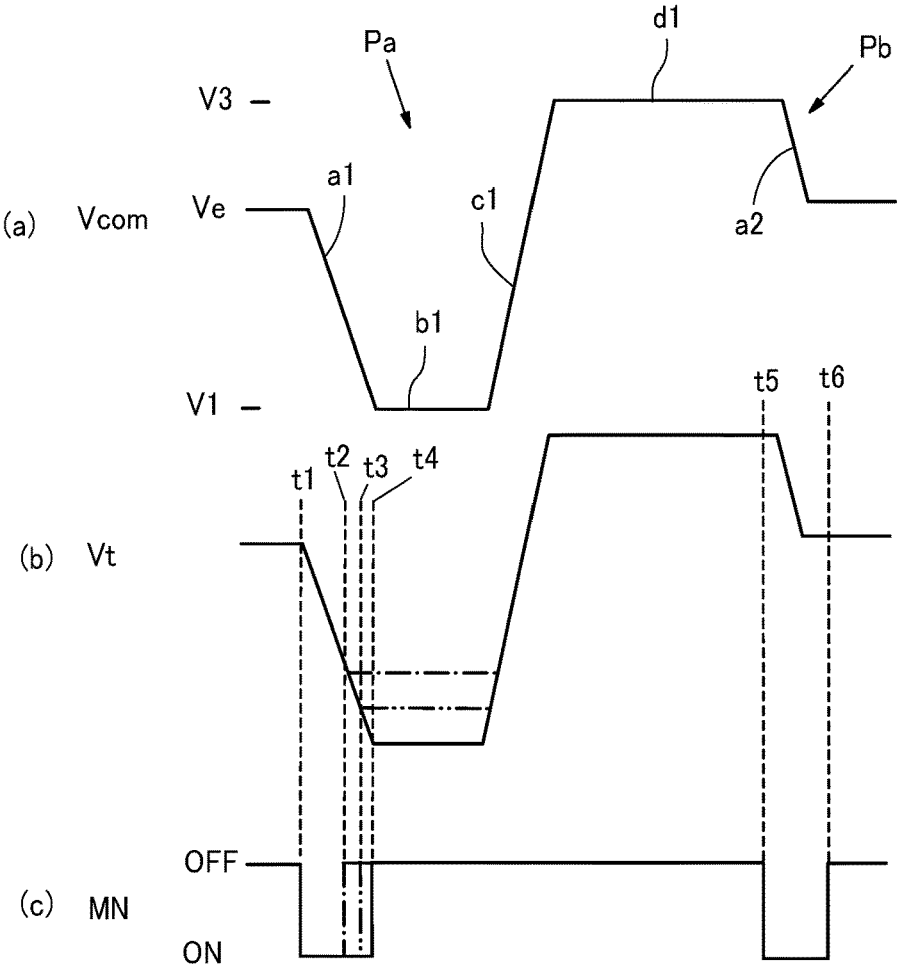
FIG. 15 is a diagram illustrating an operation of the switch portion of FIG. 14.

Next, a second embodiment of the present disclosure is described with reference to FIGS. 14 and 15. FIG. 14 is an illustration of a switch portion of a head driver according to the second embodiment. FIG. 15 is a diagram illustrating an operation of the switch portion.

In the present embodiment, the common drive waveform Vcom that is the drive voltage waveform illustrated in part (a) of FIG. 15 is input.

The common drive waveform Vcom includes a discharge waveform Pa and a damping waveform Pb.

The discharge waveform Pa includes a falling waveform element a1, a holding waveform element b1, and a rising waveform element c1. The falling waveform element a1 falls from a reference potential Ve to a potential V1 to expand the pressure chamber 21. The holding waveform element b1 holds the potential V1 that has fallen in the falling waveform element a1. The rising waveform element c1 rises from the potential V1 held by the holding waveform element b1 to a potential V3 (V3>Ve) to contract the pressure chamber 21 and discharge liquid.

The damping waveform Pb includes a holding waveform element dl for holding the potential V3 rising at the rising waveform element c1 of the discharge waveform element Pa and a falling waveform element a2. The falling waveform element a2 falls from the potential V3 held by the holding waveform element dl to the reference potential Ve to expand the pressure chamber 21. In the damping waveform Pb, liquid is not discharged.

In the present embodiment, the switching unit 430 includes a parallel circuit of the first switch S1 and the diode D, and a second switch S2 directly connected to the parallel circuit. The common drive waveform Vcom is input to and trimmed in the parallel circuit of the first switch S1 and the diode D via the second switch S2, and the trimmed drive waveform Vt is applied to the individual electrode side of the piezoelectric element 42.

The second switch S2 selects application or non-application of the drive voltage waveform to the piezoelectric element 42. In the present embodiment, the second switch S2 is disposed on the front stage side of the first switch S1.

In some embodiments, the second switch S2 may be disposed on the rear stage side of the first switch S1.

The first switch S1 is a trimming switch. The turning ON and OFF of the first switch S1 are controlled based on trimming date TD and a count value of the counter 428 as in the first embodiment.

The anode side of the diode D connected in parallel with the first switch S1 is connected to the input side of the common drive waveform Vcom of the first switch S1. The cathode side of the diode D is connected to the individual electrode side of the piezoelectric element 42. Accordingly, the diode D is connected in a direction opposite to the falling waveform element of the drive voltage waveform.

In the second embodiment configured as described above, the mask signal MN is set to the OFF state and the ON state as illustrated in part (c) of FIG. 15.

In other words, the mask signal MN transitions to the ON state from a time point t1 before the falling start of the falling waveform element a1 of the discharge waveform Pa. Thereafter, the mask signal MN transitions to the OFF state at a time point t2, a time point t3, or a time point t4 at which the counter 428 turns off the first switch S1.

Further, the mask signal MN transitions to the ON state at a time point t5 of the holding waveform element dl before the falling start of the falling waveform element a2 of the damping waveform Pb, and transitions to the OFF state at a time point t6 after the falling end of the falling waveform element a2.

The falling waveform element a1 of the discharge waveform Pa and the falling waveform element a2 of the damping waveform Pb pass through the first switch S1 when the mask signal MN is in the ON state. The rising waveform element c1 of the discharge waveform Pa is in the forward direction with respect to the diode D. Accordingly, even when the second switch S2 is turned off, the rising waveform element c1 is applied to the piezoelectric element 42 via the diode D.

Thus, the drive waveform Vt illustrated in part (b) of FIG. 13 is applied to the piezoelectric element 42.

Here, as in the first embodiment, adjustment can be performed by changing the ON time (or the switch OFF timing: t2 to t4) of the mask signal MN that passes through the falling waveform element a1 of the discharge waveform Pa.

For the falling waveform element a2 of the damping waveform Pb, the first switch S1 is turned on again, and thus the piezoelectric element 42 can be electrically discharged.

In the present embodiment, unlike the first embodiment, the second switch S2 does not also serve as a trimming switch, and thus can switch application or non-application of the drive voltage waveform regardless of trimming.

Accordingly, the common drive waveform Vcom includes a plurality of discharge pulses. Selecting one or two or more discharge pulses allows, for example, a plurality of droplet sizes (large droplet, medium droplet, and small droplet) to be selectively discharged to express gradation (non-discharge, and small, medium, and large droplets).

Further, the piezoelectric element 42 to which the drive voltage waveform is not desired to be applied can be completely disconnected by turning off the second switch S2.

Thus, even when the first switch S1 for trimming is turned off, the piezoelectric element 42 can be prevented from being charged through the diode D of the parallel circuit when a voltage higher than the reference potential Ve is applied to the first switch S1.

In other words, a waveform can be used in which the rising waveform c1 rises to a potential higher than the reference potential Ve, such as the discharge waveform Pa of the common drive waveform Vcom illustrated in part (a) of FIG. 15.

Figure 16:
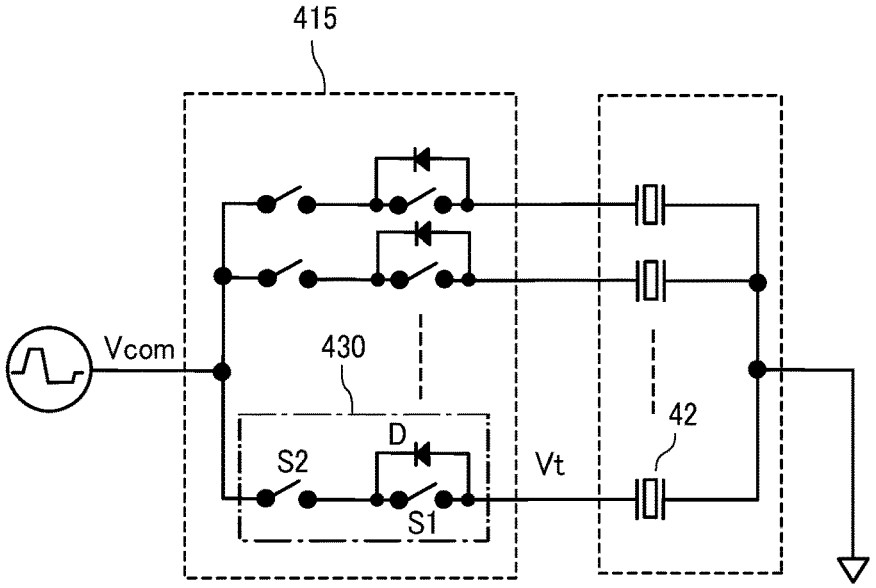
FIG. 16 is an illustration of a switch portion of a head driver according to a third embodiment of the present disclosure.
Figure 17:
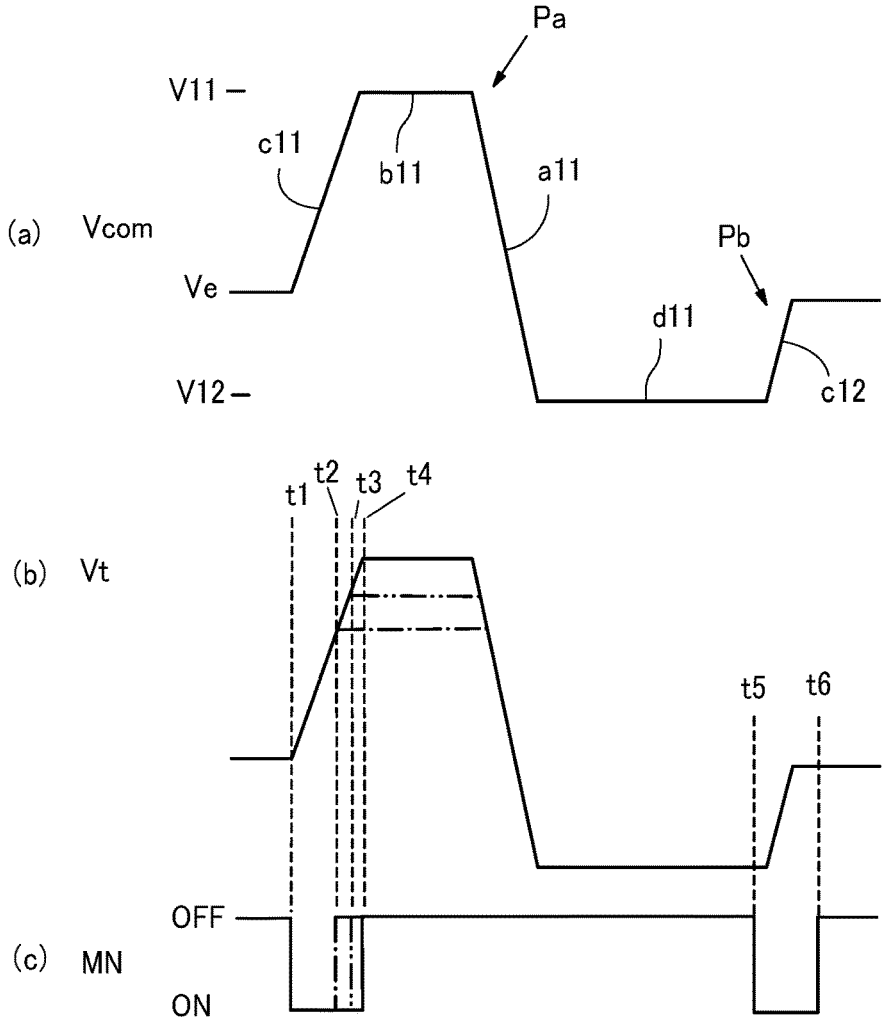
FIG. 17 is a diagram illustrating an operation of the switch portion of FIG. 16.

Next, a third embodiment of the present disclosure is described with reference to FIGS. 16 and 17. FIG. 16 is an illustration of a switch portion of a head driver according to the third embodiment. FIG. 17 is a diagram illustrating an operation of the switch portion.

In the present embodiment, even when a droplet is discharged by performing the step of pushing out a meniscus of a nozzle 11 after performing the step of pulling in the meniscus, the meniscus is pulled in at a rising edge (electric charging) of a drive voltage waveform and pushed out at a falling edge (electric discharging) of the drive voltage waveform (pulling discharge in the d31 mode) using the d31 mode of the piezoelectric element. Alternatively, even when the d33 mode of the piezoelectric element is used to pull in the meniscus at the falling edge (electric discharge) of the drive voltage waveform and push out the meniscus at the rising edge (electric charging) of the drive voltage waveform, a droplet is discharged by performing the step of pushing out the meniscus before performing the step of pulling in the meniscus (pushing discharge in the d33 mode).

Therefore, in the present embodiment, for example, the common drive waveform Vcom that is the drive voltage waveform illustrated in part (a) of FIG. 17 is input.

The common drive waveform Vcom includes a discharge waveform Pa and a damping waveform Pb.

The discharge waveform Pa includes a rising waveform element c11, a holding waveform element b11, and a falling waveform element a11. The rising waveform element c11 rises from a reference potential Ve to a potential V11 to expand the pressure chamber 21. The holding waveform element b11 holds the potential V11 that has risen in the rising waveform element c11. The falling waveform element a11 falls from the potential V11 held by the holding waveform element b11 to a potential V12 (V12<Ve) to contract the pressure chamber 21 to discharge liquid.

The damping waveform Pb includes a holding waveform element d11 that holds the potential V12 that has fallen in the falling waveform element a11 of the discharge waveform Pa, and a rising waveform element c12. The rising waveform element a2 rises from the potential V12 held by the holding waveform element d11 to the reference potential Ve to expand the pressure chamber 21. In the damping waveform Pb, liquid is not discharged.

In the present embodiment, the switching unit 430 also includes a parallel circuit of the first switch S1 and the diode D, and a second switch S2 directly connected to the parallel circuit. The common drive waveform Vcom is input to and trimmed in the parallel circuit of the first switch S1 and the diode D via the second switch S2, and the trimmed drive waveform Vt is applied to the individual electrode side of the piezoelectric element 42.

The second switch S2 selects application or non-application of the drive voltage waveform to the piezoelectric element 42. In the present embodiment, the second switch S2 is disposed on the front stage side of the first switch S1. In some embodiments, the second switch S2 may be disposed on the rear stage side of the first switch S1.

The first switch S1 is a trimming switch. The turning ON and OFF of the first switch S1 are controlled based on trimming date TD and a count value of the counter 428 as in the first embodiment.

The cathode side of the diode D connected in parallel with the first switch S1 is connected to the input side of the common drive waveform Vcom of the first switch S1. The anode side of the diode D is connected to the individual electrode side of the piezoelectric element 42. Accordingly, the diode D is connected in a direction opposite to the rising waveform element of the drive voltage waveform.

In the third embodiment configured as described above, the mask signal MN is set to the OFF state and the ON state as illustrated in part (c) of FIG. 17.

In other words, the mask signal MN transitions to the ON state from a time point t1 before the falling start of the rising waveform element c11 of the discharge waveform Pa. Thereafter, the mask signal MN transitions to the OFF state at a time point t2, a time point t3, or a time point t4 at which the counter 428 turns off the second switch S2.

Further, the mask signal MN transitions to the ON state at a time point t5 of the holding waveform element d11 before the start of rising of the rising waveform element c12 of the damping waveform Pb, and transitions to the OFF state at a time point t6 after the rising end of the rising waveform element c12.

The rising waveform element c11 of the discharge waveform Pa and the rising waveform element c12 of the damping waveform Pb pass through the first switch S1 when the mask signal MN is in the ON state. Since the falling waveform element a11 of the discharge waveform Pa is in the forward direction with respect to the diode D, the falling waveform element a11 is applied to the piezoelectric element 42 via the diode D even when the first switch S1 is turned off.

Thus, the drive waveform Vt illustrated in part (b) of FIG. 17 is applied to the piezoelectric element 42.

Here, as in the first embodiment, adjustment can be performed by changing the ON time (or the switch OFF timing: t2 to t4) of the mask signal MN that passes through the rising waveform element c11 of the discharge waveform Pa.

For the rising waveform element c12 of the damping waveform Pb, the first switch S1 is turned on again, and thus the piezoelectric element 42 can be electrically discharged.

Also in the present embodiment, unlike the first embodiment, the second switch S2 does not also serve as a trimming switch, and thus can switch application or non-application of the drive voltage waveform regardless of trimming.

Accordingly, the common drive waveform Vcom includes a plurality of discharge pulses. Selecting one or two or more discharge pulses allows, for example, a plurality of droplet sizes (large droplet, medium droplet, and small droplet) to be selectively discharged to express gradation (non-discharge, and small, medium, and large droplets).

Further, the piezoelectric element 42 to which the drive voltage waveform is not desired to be applied can be completely disconnected from a supply path of the drive voltage waveform by turning off the second switch S2.

Thus, even when the first switch S1 for trimming is turned off, the piezoelectric element 42 can be prevented from being charged through the diode D of the parallel circuit when a voltage lower than the reference potential Ve is applied to the first switch S1.

Figure 18:
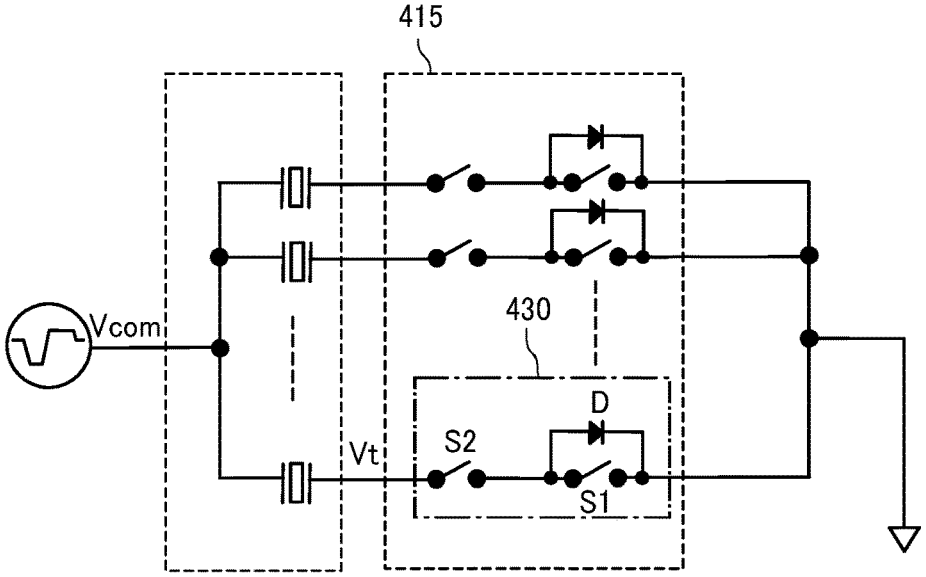
FIG. 18 is an illustration of a switch portion of a head driver according to a fourth embodiment of the present disclosure.

Next, a fourth embodiment of the present disclosure is described with reference to FIG. 18. FIG. 18 is an illustration of a switch portion of a head driver according to the fourth embodiment.

In the present embodiment, a common drive waveform Vcom, which is a drive voltage waveform, is applied to a common positive electrode of a plurality of piezoelectric elements 42, and switching units 430 are connected to the individual negative electrode side. The switching unit 430 includes a parallel circuit of a first switch S1 and a diode D, and a second switch S2 connected in series with the parallel circuit.

When the common drive waveform Vcom as illustrated in part (a) of FIG. 15 in the second embodiment described above is used, the diode D is provided so that the anode side is on the input side of the drive voltage waveform of the first switch S1 and the cathode side is on the opposite side to the input side of the drive voltage waveform.

The mask signal MN holds the first switch a1 in the ON state during a period from a time point preceding a start time point of a falling waveform element a1 of a discharge waveform Pa until the counter performs OFF control on the first switch S1. Further, the mask signal MN holds the first switch S1 in the ON state from a time point of a holding waveform element dl preceding a start time point of a falling waveform element a2 of a damping waveform Pb to a time point after a falling end of the falling waveform element a2.

In the present embodiment, in the case in which the common drive waveform Vcom illustrated in part (a) of FIG. 13 in the first embodiment is used, the first switch S1 may be deleted. In the case in which the common drive waveform Vcom illustrated in part (b) of FIG. 17 in the third embodiment is used, the direction of the diode D may be reversed.

Figure 19:
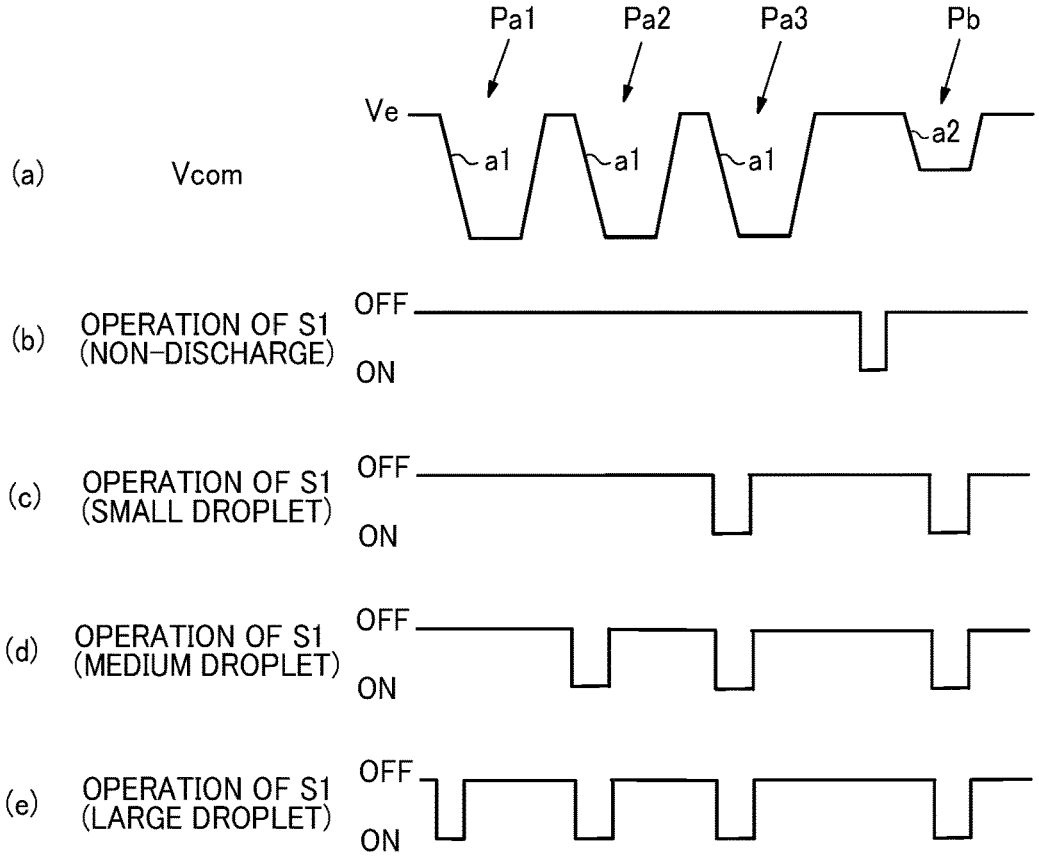
FIG. 19 is a diagram illustrating an operation of a switch portion of a head driver according to a fifth embodiment of the present disclosure.

Next, a fifth embodiment of the present disclosure is described with reference to FIG. 19. FIG. 19 is a diagram illustrating an operation of a switch portion of a head driver according to the fifth embodiment.

The switch portion of the head driver in the present embodiment is the same as the switch portion in the first embodiment (FIG. 12).

In the present embodiment, the common drive waveform Vcom as illustrated in part (a) of FIG. 19 is used. A common drive waveform Vcom includes three discharge waveforms Pa1, Pa2, and Pa3 arranged in time series and a damping waveform Pb. The waveform elements of the discharge waveforms Pa1, Pa2, and Pa3 and the damping waveform Pb are the same as the waveform elements described in the first embodiment.

By controlling ON and OFF of the first switch S1 by the mask signal MN, passing or non-passing of the discharge waveforms Pa1, Pa2, and Pa3 and the damping waveform Pb included in the common drive waveform Vcom is selected to perform gradation control.

In other words, when non-discharge operation is performed, as illustrated in part (b) of FIG. 19, the first switch S1 is turned on between the discharge waveform Pa3 and the damping waveform Pb.

When a small droplet is discharged, as illustrated part (c) of FIG. 19, the first switch S1 is turned ON at the falling waveform element a1 of the discharge waveform Pa3 and the falling waveform element a2 of the damping waveform Pb. Thus, the discharge waveform Pa3 is applied to the piezoelectric element 42, and the droplet is discharged.

When a middle droplet is discharged, as illustrated in part (d) of FIG. 19, the first switch S1 is turned ON in each falling waveform element a1 of the discharge waveforms Pa2 and Pa3 and at the falling waveform element a2 of the damping waveform Pb. Thus, the discharge waveforms Pa2 and Pa3 are sequentially applied to the piezoelectric element 42, and two droplets are sequentially discharged and, for example, combined into one droplet during flight.

When a large droplet is discharged, as illustrated in part (e) of FIG. 19, the first switch S1 is turned ON in each falling waveform element a1 of the discharge waveforms Pa1, Pa2, and Pa3 and at the falling waveform element a2 of the damping waveform Pb. Thus, the discharge waveforms Pa1, Pa2, and Pa3 are sequentially applied to the piezoelectric element 42, and three droplets are discharged and, for example, combined into one droplet during flight.

The adjustment described in the first embodiment is performed by changing the timing at which the first switch S1 is switched from the ON state to the OFF state in each falling waveform element a1 of the discharge waveforms Pa1, Pa2, and Pa3.

Figure 20:
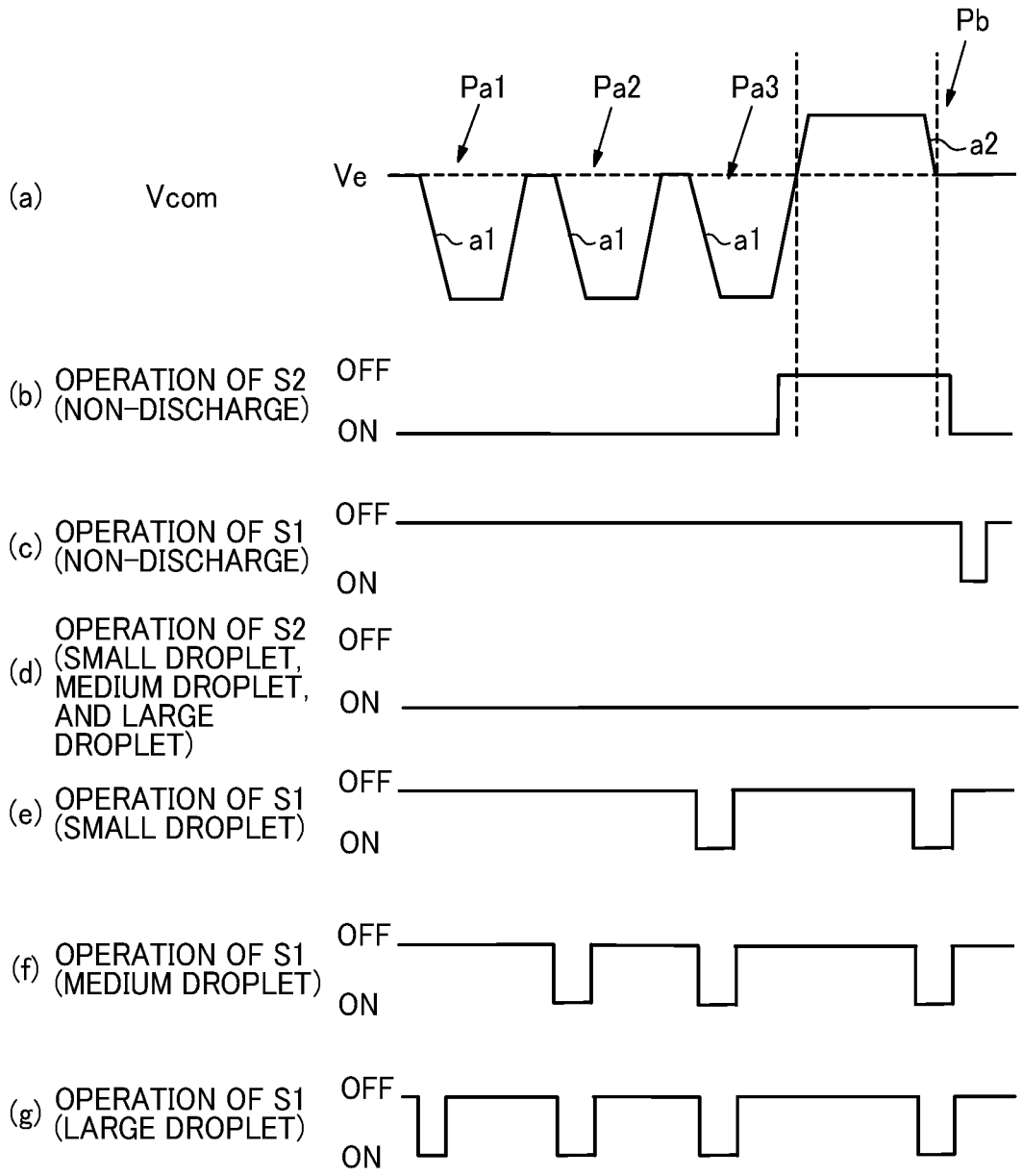
FIG. 20 is a diagram illustrating an operation of a switch portion of a head driver according to a sixth embodiment of the present disclosure.

Next, a sixth embodiment of the present disclosure is described with reference to FIG. 20. FIG. 20 is a diagram illustrating an operation of a switch portion of a head driver according to the sixth embodiment.

The switch portion of the head driver in the present embodiment is the same as that in the second embodiment (FIG. 14).

In the present embodiment, the common drive waveform Vcom as illustrated in part (a) of FIG. 20 is used. A common drive waveform Vcom includes three discharge waveforms Pa1, Pa2, and Pa3 arranged in time series and a damping waveform Pb. The waveform elements of the discharge waveforms Pa1, Pa2, and Pa3 and the damping waveform Pb are the same as the waveform elements described in the second embodiment.

By controlling ON and OFF of the first switch S1 by the mask signal MN, passing or non-passing of the discharge waveforms Pa1, Pa2, and Pa3 and the damping waveform Pb included in the common drive waveform Vcom is selected to perform gradation control.

In other words, when non-discharge operation is performed, as illustrated in part (c) of FIG. 20, the first switch S1 is turned on at the reference potential Ve after the falling end of the falling waveform element a2 of the damping waveform Pb to perform the supplementary charging.

When a small droplet is discharged, as illustrated part (e) of FIG. 20, the first switch S1 is turned ON at the falling waveform element a1 of the discharge waveform Pa3 and the falling waveform element a2 of the damping waveform Pb. Thus, the discharge waveform Pa3 is applied to the piezoelectric element 42, and the droplet is discharged.

When a middle droplet is discharged, as illustrated in part (f) of FIG. 20, the first switch S1 is turned ON in each falling waveform element a1 of the discharge waveforms Pa2 and Pa3 and at the falling waveform element a2 of the damping waveform Pb. Thus, the discharge waveforms Pa2 and Pa3 are sequentially applied to the piezoelectric element 42, and two droplets are sequentially discharged and, for example, combined into one droplet during flight.

When a large droplet is discharged, as illustrated in part (g) of FIG. 20, the first switch S1 is turned ON in each falling waveform element a1 of the discharge waveforms Pa1, Pa2, and Pa3 and at the falling waveform element a2 of the damping waveform Pb. Thus, the discharge waveforms Pa1, Pa2, and Pa3 are sequentially applied to the piezoelectric element 42, and three droplets are discharged and, for example, combined into one droplet during flight.

The adjustment described in the first embodiment is performed by changing the timing at which the first switch S1 is switched from the ON state to the OFF state in each falling waveform element a1 of the discharge waveforms Pa1, Pa2, and Pa3.

On the other hand, with respect to the second switch S2, as illustrated in part (b) of FIG. 20, a non-discharge nozzle is turned off in a portion in which a potential higher than the reference potential Ve is applied to the switching unit 430. For example, the non-discharge nozzle may be turned off in the entire drive voltage waveform. As illustrated in part (b) of FIG. 20, the nozzles that discharge small, medium, and large droplets are set to the ON state in the entire drive voltage waveform.

Figure 21:
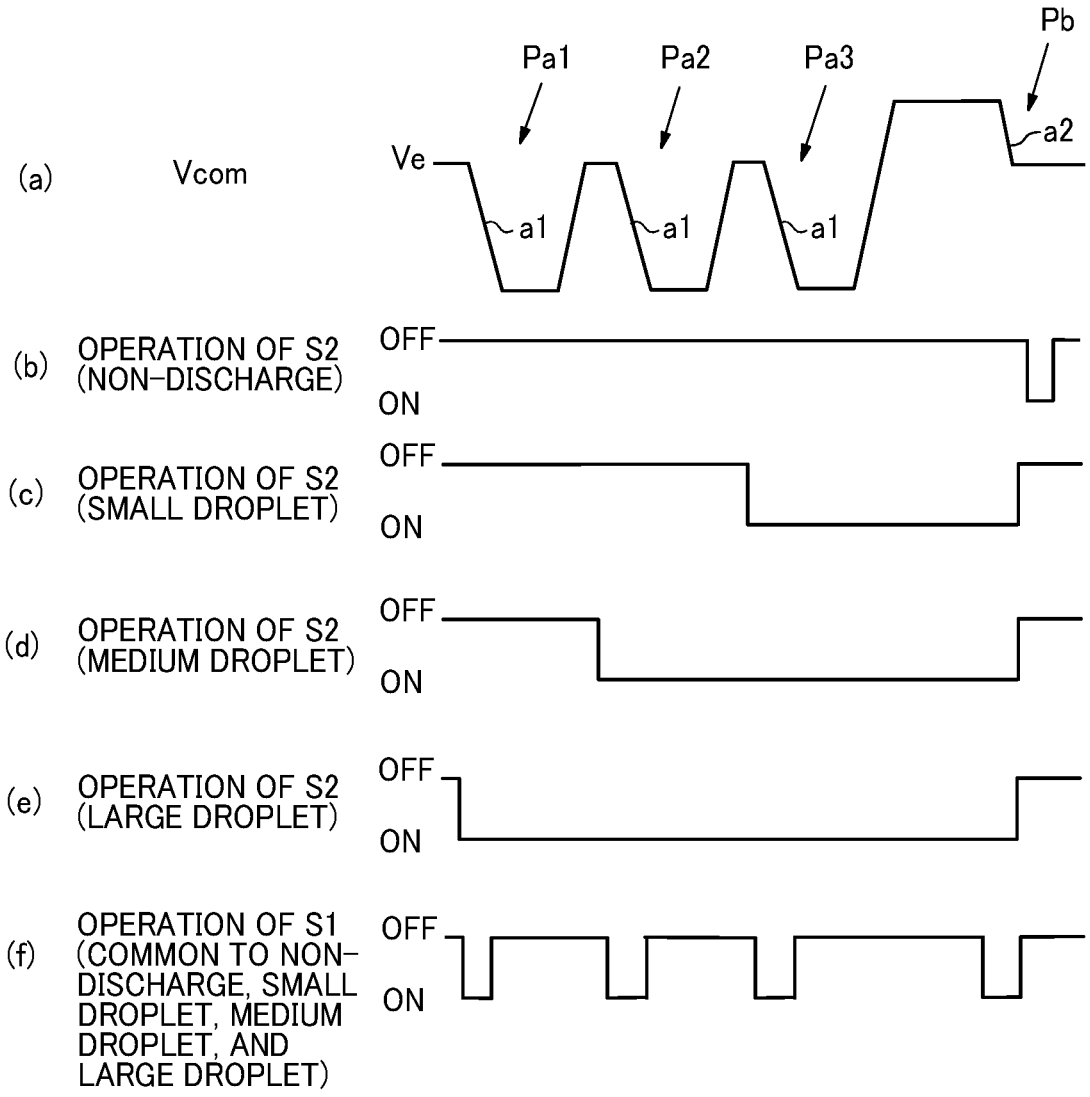
FIG. 21 is a diagram illustrating an operation of a switch portion of a head driver according to a seventh embodiment of the present disclosure.

Next, a seventh embodiment of the present disclosure is described with reference to FIG. 21. FIG. 21 is a diagram illustrating an operation of a switch portion of a head driver according to the sixth embodiment.

The switch portion of the head driver in the present embodiment is the same as that in the second embodiment (FIG. 14).

In the present embodiment, the common drive waveform Vcom as illustrated in part (a) of FIG. 21 is used. A common drive waveform Vcom includes three discharge waveforms Pa1, Pa2, and Pa3 arranged in time series and a damping waveform Pb. The waveform elements of the discharge waveforms Pa1, Pa2, and Pa3 and the damping waveform Pb are the same as the waveform elements described in the second embodiment.

For the nozzles of non-discharge, small droplet, medium droplet, and large droplet, as illustrated in part (f) of FIG. 21, the first switch S1 is commonly turned on for each falling waveform element a1 of discharge waveform Pa1, Pa2, and Pa3 and the falling waveform element a2 of the damping waveform Pb.

On the other hand, as illustrated in part (b) of FIG. 21, the second switch S2 is set to the ON state at the reference potential Ve to perform the supplementary charging for the non-discharge nozzle.

As for the nozzle of the small droplet, as illustrated in part (c) of FIG. 21, the second switch S2 is set to the ON state across the discharge waveform Pa3 and the damping waveform Pb. As for the nozzle of the middle droplet, as illustrated in part (d) of FIG. 21, the second switch S2 is set to the ON state across the discharge waveforms Pa2 and Pa3 and the damping waveform Pb. As for the nozzle of the large droplet, as illustrated in part (e) of FIG. 21, the second switch S2 is set to the ON state across the discharge waveforms Pa1, Pa2, and Pa3 and the damping waveform Pb.

In other words, the second switch S2 is controlled to be turned on and off in accordance with the droplet size to express gradation.

In the above embodiment, trimming usually includes not only matching of the droplet speed and droplet weight of a plurality of nozzles but also adjustment other than matching, such as making the droplet size of a nozzle larger than the droplet size of other nozzles.

In the present disclosure, the liquid to be discharged is not limited to a particular liquid as long as the liquid has a viscosity or surface tension to be discharged from a head (liquid discharge head). However, preferably, the viscosity of the liquid is not greater than 30 mPa·s under ordinary temperature and ordinary pressure or by heating or cooling. More specifically, the liquid to be discharged is a solution, a suspension liquid, an emulsion, or the like containing a solvent such as water or an organic solvent, a colorant such as a dye or a pigment, a function-imparting material such as a polymerizable compound, a resin, or a surfactant, a biocompatible material such as deoxyribonucleic acid (DNA), amino acid, protein, or calcium, or an edible material such as a natural pigment, which can be used, for example, for an inkjet ink, a surface treatment liquid, a liquid for forming a constituent element of an electronic element or a light emitting element or an electronic circuit resist pattern, a three-dimensional modeling material liquid, or the like.

Examples of an energy source for generating energy to discharge liquid include a capacitive actuator other than a piezoelectric actuator (a laminated piezoelectric element or a thin-film piezoelectric element).

Examples of the liquid discharge apparatus include, not only apparatuses capable of discharging liquid to materials to which liquid can adhere, but also apparatuses to discharge a liquid toward gas or into a liquid.

The liquid discharge apparatus may include a means relating to feeding, conveyance, and sheet ejection of the material to which liquid can adhere and also include a pre-treatment apparatus and a post-processing apparatus.

The liquid discharge apparatus may be, for example, an image forming apparatus to form an image on a sheet by discharging ink, or a three-dimensional apparatus to discharge a molding liquid to a powder layer in which powder material is formed in layers, so as to form a three-dimensional article.

The liquid discharge apparatus is not limited to an apparatus that discharges liquid to visualize meaningful images such as letters or figures. For example, the liquid discharge apparatus may be an apparatus that forms meaningless images such as meaningless patterns or an apparatus that fabricates three-dimensional images.

The above-described term "material to which liquid can adhere" denotes, for example, a material or a medium to which liquid can adhere at least temporarily, a material or a medium to which liquid can attach and firmly adhere, or a material or a medium to which liquid can adhere and into which the liquid permeates. Specific examples of the "material to which liquid can adhere" include, but are not limited to, a recording medium such as a paper sheet, recording paper, a recording sheet of paper, a film, or cloth, an electronic component such as an electronic substrate or a piezoelectric element, and a medium such as layered powder, an organ model, or a testing cell. The "material to which liquid is adherable" includes any material to which liquid is adhered, unless particularly limited.

Examples of the material to which liquid can adhere include any materials to which liquid can adhere even temporarily, such as paper, thread, fiber, fabric, leather, metal, plastic, glass, wood, and ceramic.

The liquid discharge apparatus may be an apparatus to relatively move a liquid discharge head and a material on which liquid can adhere. However, the liquid discharge apparatus is not limited to such an apparatus. Examples of the liquid discharge apparatus include a serial type apparatus which moves the liquid discharge head, and a line type apparatus which does not move the liquid discharge head.

Examples of the liquid discharge apparatus further include a treatment liquid coating apparatus to discharge a treatment liquid to a sheet to coat the treatment liquid on a sheet surface to reform the sheet surface and an injection granulation apparatus in which a composition liquid including raw materials dispersed in a solution is discharged through nozzles to granulate fine particles of the raw materials.

The terms "image formation", "recording", "printing", "image printing", and "fabricating" are herein used as synonyms.

The above-described embodiments are illustrative and do not limit the present disclosure. Thus, numerous additional modifications and variations are possible in light of the above teachings. For example, elements and/or features of different illustrative embodiments may be combined with each other and/or substituted for each other within the scope of the present disclosure. The elements of the above-described embodiments can be modified without departing from the gist of the present disclosure, and can be appropriately determined according to the application form.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

The invention claimed is:

1. A liquid discharge apparatus, comprising:

a head including a piezoelectric element and a pressure chamber configured to discharge liquid;

a switching device configured to select application or non-application of a drive voltage waveform to the piezoelectric element; and a head controller configured to control the switching device based on trimming data, wherein the drive voltage waveform includes:

a discharge waveform to pressurize and discharge the liquid in the pressure chamber, the discharge waveform including a first falling waveform element; and a damping waveform to suppress residual vibration in the pressure chamber, the damping waveform including a holding waveform element and a second falling waveform element, and the damping waveform is disposed after the discharge waveform in time series, wherein the switching device includes:

a switch configured to be turned on in the first falling waveform element of the discharge waveform and the second falling waveform element of the damping waveform, the switch further configured to be turned off during a period after the switch has been turned on while the first falling waveform element continues, the switch further configured to be turned back on during the holding waveform element; and a diode connected in parallel with the switch in a direction opposite to the falling waveform element of each of the discharge waveform and the damping waveform;

wherein the head controller is configured to control a timing, at which the switch is turned off while the first falling waveform element continues, based on the trimming data.

2. The liquid discharge apparatus according to claim 1, wherein the switch is configured to be turned off in a rising waveform element of the discharge waveform.

3. A liquid discharge apparatus, comprising:

a head including a piezoelectric element and a pressure chamber configured to discharge liquid;

a switching device configured to select application or non-application of a drive voltage waveform to the piezoelectric element; and a head controller configured to control the switching device based on trimming data, wherein the drive voltage waveform includes:

a discharge waveform to pressurize and discharge the liquid in the pressure chamber, the discharge waveform including a first rising waveform element; and a damping waveform to suppress residual vibration in the pressure chamber, the damping waveform including a second rising waveform element and a holding waveform element; and the damping waveform is disposed after the discharge waveform in time series, wherein the switching device includes:

a switch configured to be turned on in the first rising waveform element of the discharge waveform and the second rising waveform element of the damping waveform, the switch further configured to be turned off during a period after the switch has been turned on while the first rising waveform element continues, the switch further configured to be turned back on during the holding waveform element and turned back off after the damping waveform has been applied; and a diode connected in parallel with the switch in a direction opposite to the rising waveform element of each of the discharge waveform and the damping waveform;

wherein the head controller is configured to control a timing, at which the switch is turned off while the first rising waveform element continues, based on the trimming data.

4. The liquid discharge apparatus according to claim 3, wherein the switch is configured to be turned off in a falling waveform element of the discharge waveform.

5. The liquid discharge apparatus according to claim 3, wherein the switching device includes another switch connected in series to a parallel circuit of the switch and the diode, and wherein said another switch is configured to be turned off when a potential lower than at least a reference potential of the drive voltage waveform is applied.

6. The liquid discharge apparatus according to claim 5, wherein said another switch is configured to be turned on and off in accordance with a size of a droplet to be discharged.

7. The liquid discharge apparatus according to claim 1, wherein the switching device includes another switch connected in series to a parallel circuit of the switch and the diode, and wherein said another switch is configured to be turned off when a potential higher than at least a reference potential of the drive voltage waveform is applied.

8. The liquid discharge apparatus according to claim 7, wherein said another switch is configured to be turned on and off in accordance with a size of a droplet to be discharged.

9. A head drive control device, comprising a switching device configured to select application or non-application of a drive voltage waveform to a piezoelectric element of a head configured to discharge liquid, and a head controller configured to control the switching device based on trimming data, wherein the drive voltage waveform includes:

a discharge waveform to pressurize and discharge the liquid in a pressure chamber of the head, the discharge waveform including a first falling waveform element; and a damping waveform to suppress residual vibration in the pressure chamber, the damping waveform including a holding waveform element and a second falling waveform element, and the damping waveform is disposed after the discharge waveform in time series, wherein the switching device includes:

a switch configured to be turned on in a falling waveform element of each of the discharge waveform and the damping waveform, the switch further configured to be turned off during a period after the switch has been turned on while the first falling waveform element continues, the switch further configured to be turned back on during the holding waveform element; and a diode connected in parallel with the switch in a direction opposite to the falling waveform element of each of the discharge waveform and the damping waveform, wherein the head controller is configured to control a timing, at which the switch is turned off while the first falling waveform element continues, based on the trimming data.

* * * * *